US008695862B2

(12) United States Patent
Wu et al.

(10) Patent No.: US 8,695,862 B2
(45) Date of Patent: Apr. 15, 2014

(54) OSCILLATION REDUCING SUSPENSION DEVICE FOR A FAN MOTOR OF A COMBUSTION-POWERED TOOL

(75) Inventors: Jian-Rung Wu, Taichung (TW); Kun-Ta Wu, Taichung (TW); Chang-Sheng Lin, Taichung (TW); Chien-Kuo Po, Taichung (TW)

(73) Assignee: Basso Industry Corp., Taichung (TW)

( * ) Notice: Subject to any disclaimer, the term of this patent is extended or adjusted under 35 U.S.C. 154(b) by 127 days.

(21) Appl. No.: 12/727,133

(22) Filed: Mar. 18, 2010

(65) Prior Publication Data

US 2010/0237127 A1 Sep. 23, 2010

(30) Foreign Application Priority Data

Mar. 20, 2009 (TW) ..... 098109147 A

(51) Int. Cl.
*B25C 1/14* (2006.01)
*B25C 1/18* (2006.01)

(52) U.S. Cl.
USPC ..... 227/10; 227/130; 173/162.1; 173/162.2; 310/50

(58) Field of Classification Search
USPC ..... 227/10, 130; 173/162.1, 162.2; 310/50–51, 91; 248/610, 638; 123/46 H, 46 SC
See application file for complete search history.

(56) References Cited

U.S. PATENT DOCUMENTS 4,032,806 A * 6/1977 Seely ..... 310/50
6,619,527 B1 9/2003 Moeller
7,118,018 B2 10/2006 Turk

FOREIGN PATENT DOCUMENTS

JP 06074491 A * 3/1994

* cited by examiner

*Primary Examiner* — Michelle Lopez
(74) *Attorney, Agent, or Firm* — Holland & Hart, LLP

(57) ABSTRACT

An oscillation reducing suspension device for a fan motor of a combustion-powered tool includes a rigid axial-play setting unit mounted on an upper major surface of a cylinder head, and having upper and lower limit defining members that are spaced apart from each other by an axial play route, a suspending mount configured to keep the fan motor oriented in a rotary axis, and having a lug which extends radially into the axial play route to divide the axial play route into proximate and distal regions, and an elastomeric damper unit having upper and lower damping members respectively disposed in the distal and proximate regions. By virtue of the rigid mount supporting the fan motor, and the resilient damper unit coupling the mount and the cylinder head, the fan motor is firmly secured to the cylinder head, and axial oscillation of the fan motor is reduced.

7 Claims, 7 Drawing Sheets

OSCILLATION REDUCING SUSPENSION DEVICE FOR A FAN MOTOR OF A COMBUSTION-POWERED TOOL

CROSS-REFERENCE TO RELATED APPLICATION

This application claims priority of Taiwanese patent Application No. 098109147, filed on Mar. 20, 2009, the disclosure of which is herein incorporated by reference.

BACKGROUND OF THE INVENTION

1. Field of the Invention

This invention relates to a combustion-powered tool, more particularly to an oscillation reducing suspension device for a fan motor of a combustion-powered tool, such as a pistol-like tool powered by a pressurized fuel gas for driving a fastener into a workpiece.

2. Description of the Related Art

Referring to FIG. 1, a fan motor suspension mechanism for a combustion-powered tool disclosed in U.S. Pat. No. 7,118,018 is shown to include a cylinder head 11 defining a cavity 111 to accommodate a fan motor 13 therein. An armature shaft 131 of the fan motor 13 extends through a floor wall of the cavity 111 to drive rotation of a fan 12 that is disposed in a combustion chamber (not shown) for providing efficient combustion within the chamber. The suspension mechanism further includes an inner annular ring 15 attached securely to a surrounding wall of the fan motor 13, an outer annular ring 16 secured to the cylinder head 11, and a central resilient web 14 extending radially between the inner and outer rings 15, 16 and configured to allow slight axial movement of the fan motor 13 so as to provide resilience to the fan motor 13 and thus shock absorption for the motor 13 upon combustion in the combustion chamber. However, due to the configuration of the central resilient web 14 that is liable to be deformed, assembly of the motor 13 is difficult to conduct and connection between the motor 13 and the cylinder head 11 is unstable. Slippage of the motor 13 from the suspension mechanism may occur during oscillation of the motor 13 in the course of operation of the tool.

Referring to FIGS. 2 and 3, another motor suspension mechanism for a combustion-powered tool is disclosed in U.S. Pat. No. 6,619,527, and includes a cylinder head 81 for accommodating a fan motor 83 such that an armature shaft of the motor 83 extends through a floor wall of the cylinder head 81 and drives a fan 82, a rigid circular motor retaining cup 84 attached to the motor 83 and providing a heat and dirt barrier for protecting the motor 83, and a mounting bracket 88 secured to the cylinder head 81 by means of fasteners 87. The mounting bracket 88 includes inner and outer sidewalls 881, 882 which are respectively attached to inner and outer portions of an annular resilient web 89 so as to secure the mounting bracket 88 to the retaining cup 84. The resilient web 89 is provided to minimize the operational dynamics of the combustion chamber caused by the combustion on the motor and also to protect the motor from axial acceleration and large oscillations. In addition, the mounting bracket 88 is retained in an axially spaced relationship relative to the cylinder head 81 by resilient spacer members 86. Thus, a shock absorbing and isolating effect to decrease the operational dynamics of the combustion chamber caused by the combustion on the motor 83 can be achieved to thereby protect the motor 83 from axial acceleration and oscillations. Since the resilient web 89 is confined by the inner and outer sidewalls 881, 882, the damping force of the resilient web 89 is reduced, and the resilient spacer members 86 are additionally required, thereby rendering the construction of the suspension mechanism complicated and assembly inconvenient.

SUMMARY OF THE INVENTION

An object of the present invention is to provide an oscillation reducing suspension device for a fan motor of a combustion-powered tool which has a simplified construction and which provides an efficient shock absorbing effect for reducing axial oscillation of the fan motor.

According to this invention, the oscillation reducing suspension device includes at least one axial-play setting unit, a suspending mount, and at least one damper unit. The axial-play setting unit is adapted to be mounted on an upper major surface of a cylinder head of a combustion-powered tool, and is configured to have upper and lower limit defining members that are spaced apart from each other by an axial play route extending parallel to a rotary axis of a fan motor, and that are made from a rigid material. The suspending mount is configured to keep a barrel wall of the fan motor oriented in the rotary axis, and includes at least one lug which is disposed to correspond to the axial-play setting unit, and which extends radially relative to the rotary axis and into the axial play route such that the axial play route is divided into proximate and distal regions relative to the upper major surface. The damper unit is made from a resilient material, and includes upper and lower damping members respectively disposed in the distal and proximate regions. By virtue of the rigid mount that supports the fan motor, and by virtue of the resilient damper unit that couples the mount and the cylinder head, the fan motor is firmly secured to the cylinder head and axial oscillation of the fan motor during operation of the tool is reduced.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
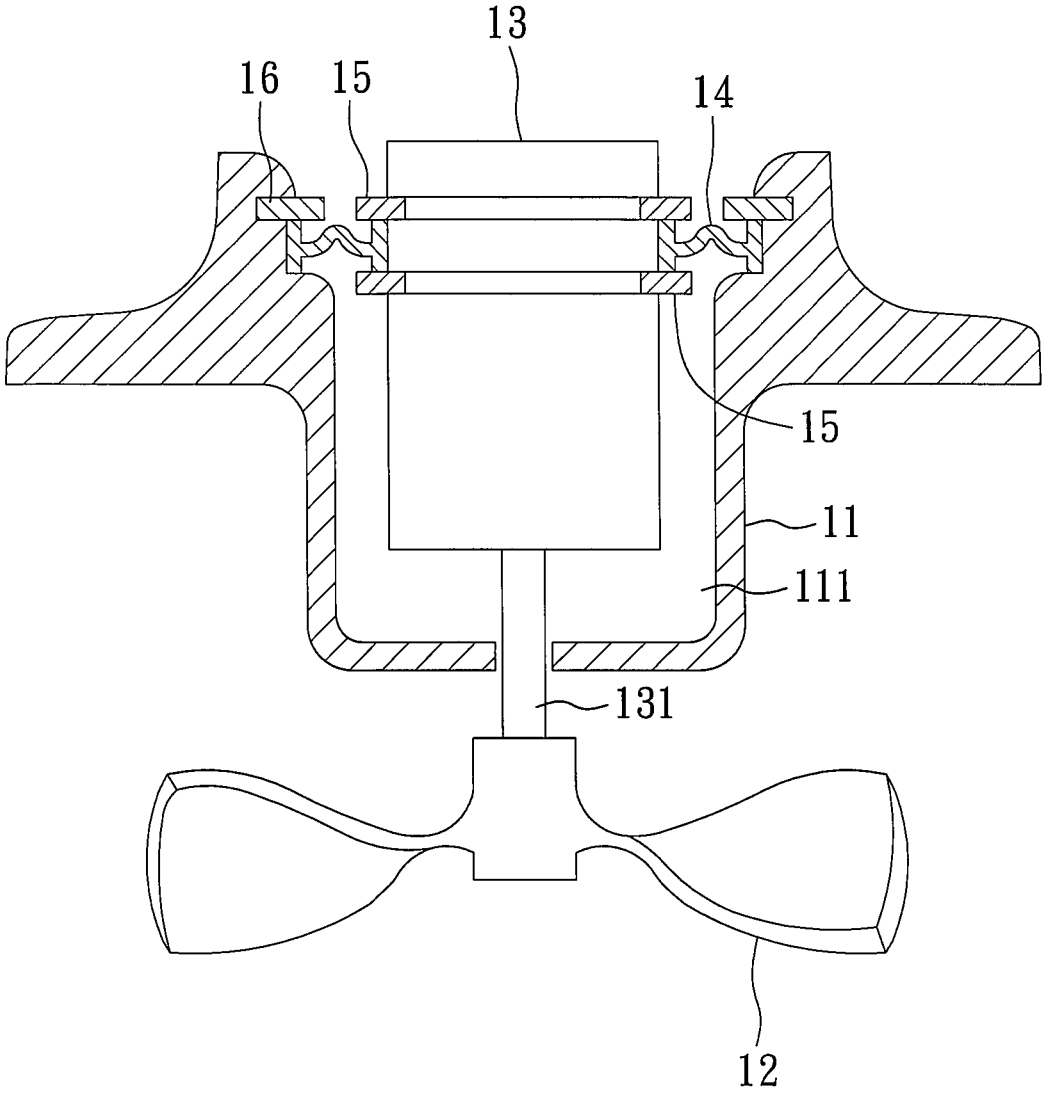
FIG. 1 PRIOR ART
FIG. 1 is a sectional view of a conventional fan motor suspension mechanism for a combustion-powered tool.
Figure 2:
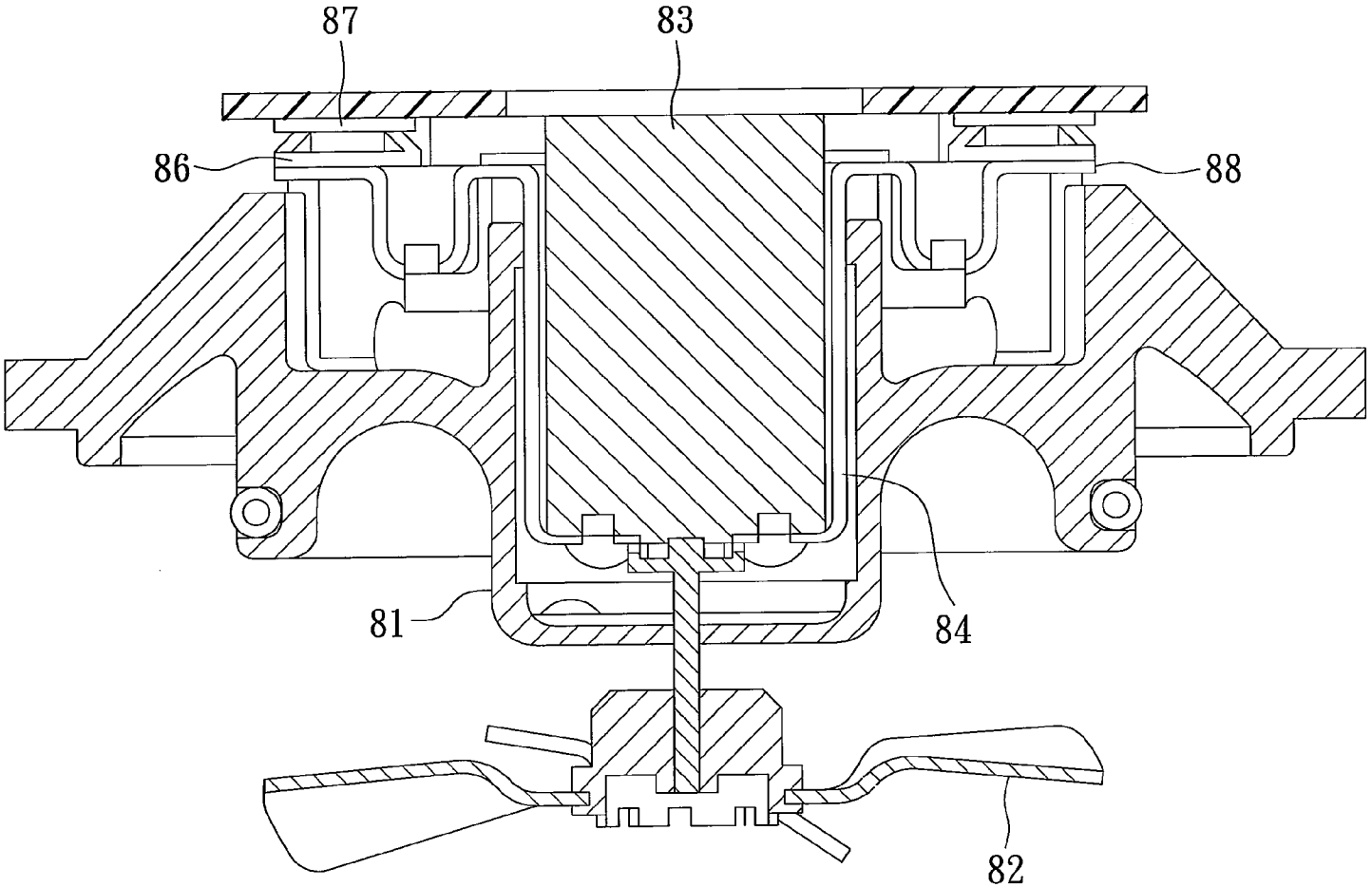
FIG. 2 PRIOR ART
FIG. 2 is a sectional view of another conventional fan motor suspension mechanism for a combustion-powered tool.
Figure 3:
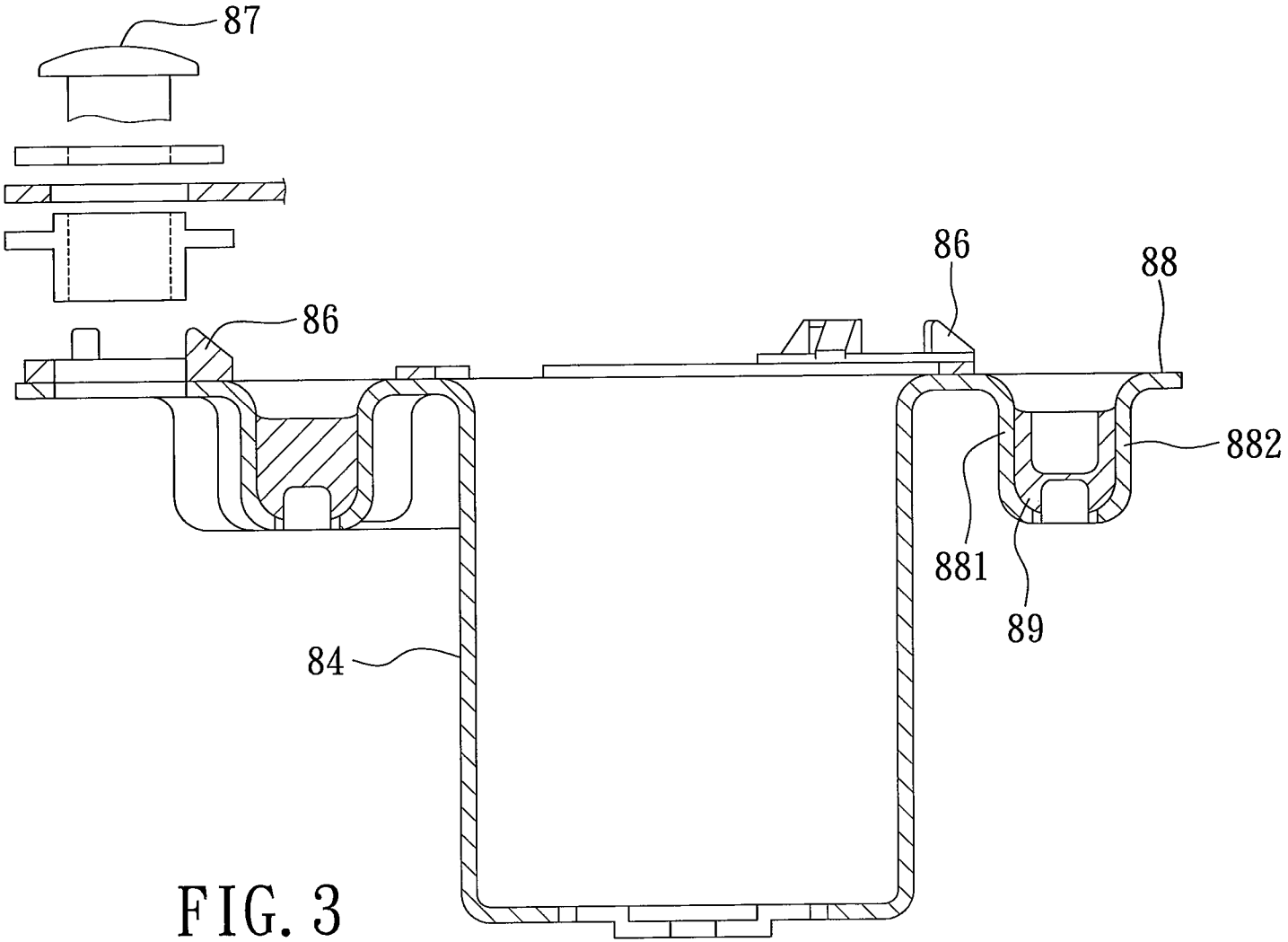
FIG. 3 PRIOR ART
FIG. 3 is a fragmentary exploded sectional view of the conventional fan motor suspension mechanism.
Figure 4:
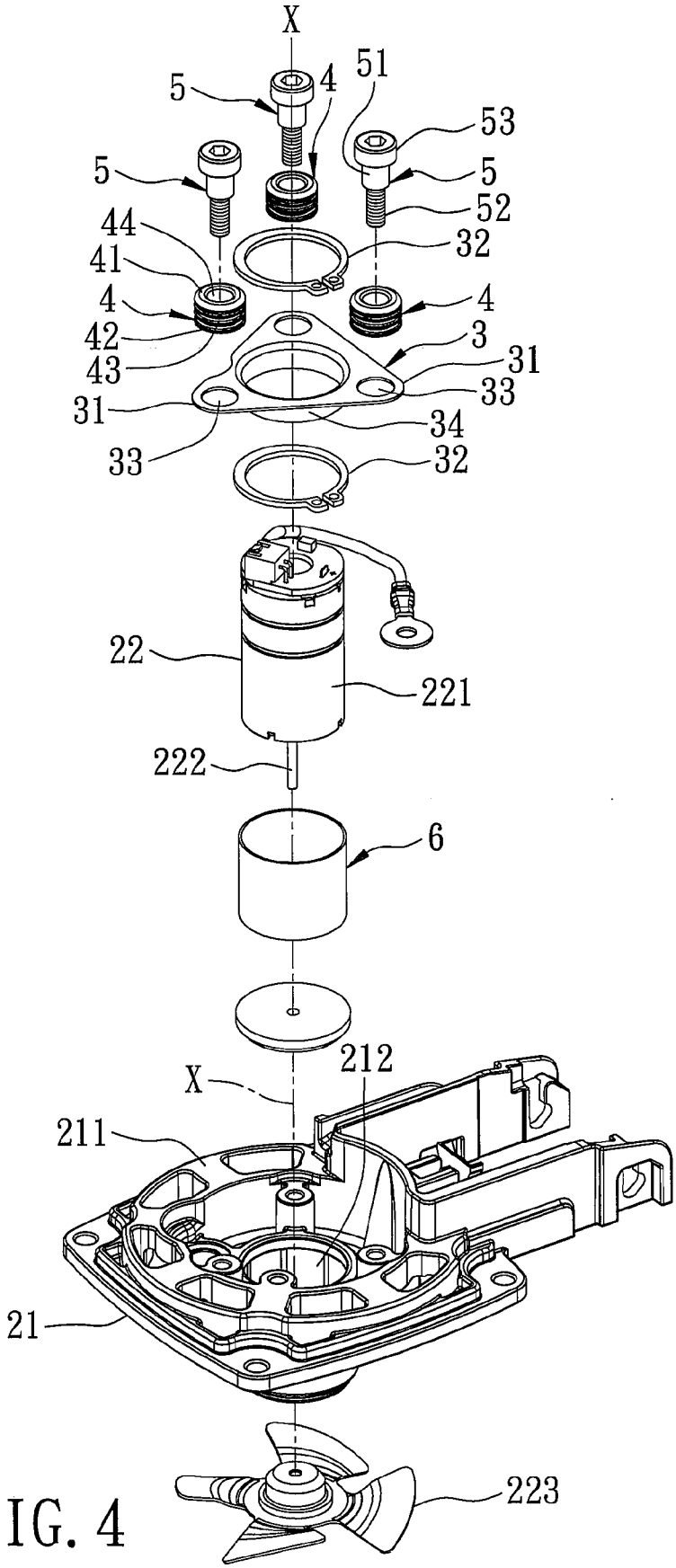
FIG. 4 is an exploded perspective view of the preferred embodiment of an oscillation reducing suspension device for a fan motor and a cylinder head of a combustion-powered tool according to this invention.

Referring to FIGS. 4 to 7, the preferred embodiment of an oscillation reducing suspension device for a fan motor 22 of a combustion-powered tool (not shown) according to the present invention is shown to be mounted in a cylinder head 21 of the combustion-powered tool, such as a pistol-like fastening hand tool. The cylinder head 21 is disposed to cover a combustion chamber (not shown) in the tool, and has an upper major surface 211 defining a cavity 212 that extends along a rotary axis (X) for accommodating the fan motor 22 and that terminates at a floor surface 214. The floor surface 214 has a passage 213 communicating the cavity 212 with the combustion chamber so as to permit an armature shaft 222 of the fan motor 22 to extend into the combustion chamber. A fan 223 is received in the combustion chamber to be rotated with the armature shaft 222. The oscillation reducing suspension device of the embodiment according to this invention comprises a suspending mount 3, three damper units 4, three axial-play setting units 5, and a heat-insulating bushing 6.

The suspending mount 3 is made of a rigid metal material, such as iron, and includes a tubular wall 34 which surrounds and which extends along the rotary axis (X) and which terminates at upper and lower tubular ends 341, 342, three lugs 31 which extend radially from the upper tubular end 341 and which are angularly displaced from one another about the rotary axis (X), and upper and lower retaining hoops 32 which are configured to flank the tubular wall 39 along the rotary axis (X) such that the upper and lower retaining hoops 32 are brought to respectively abut against the upper and lower tubular ends 341, 342. The tubular wall 34 is adapted to be sleeved on a barrel wall 221 of the fan motor 22, and the upper and lower retaining hoops 32 are adapted to hoop around the barrel wall 221 of the fan motor 22, thereby ensuring immobility of the suspending mount 3 relative to the fan motor 22, and keeping the barrel wall 221 of the fan motor 22 oriented in the rotary axis (X). Each of the lugs 31 has a mounting hole 33 extending therethrough along an axial play route that extends parallel to the rotary axis (X).

Each of the damper units 4 is made from an elastomeric material, such as rubber, and includes a neck member 43 configured to fit in the mounting hole 33, and upper and lower damping members 41, 42 extending from the neck member 43 and disposed opposite to each other and in proximate and distal regions of the axial play route relative to the upper major surface 211 of the cylinder head 21. In this embodiment, the neck member 43 is integrally formed with the upper and lower damping members 41, 42 so that the damper unit 4 is formed as a single-piece structure. Each of the damper units 4 has a penetrating hole 44 extending therethrough to define part of the axial play route.

Each of the axial-play setting units 5 is in the form of a bolt made from a rigid metal material, and has an enlarged head 53 abutting against the upper damping member 41 of the respective damper unit 4 to serve as an upper limit defining member, a shank extending from the enlarged head 53 and including an insert segment 51 that is insertable into the penetrating hole 44, and a threaded segment 52 that is disposed to be in threaded engagement with the upper major surface 211 of the cylinder head 21 to serve as a lower limit defining member so as to permit adjustment of the length of the axial play route.

The heat-insulating bushing 6 is adapted to be disposed in the cavity 212 of the cylinder head 21, and is configured to surround the barrel wall 221 of the fan motor 22 so as to prevent non-axial movement of the fan motor 22.

Figure 5:
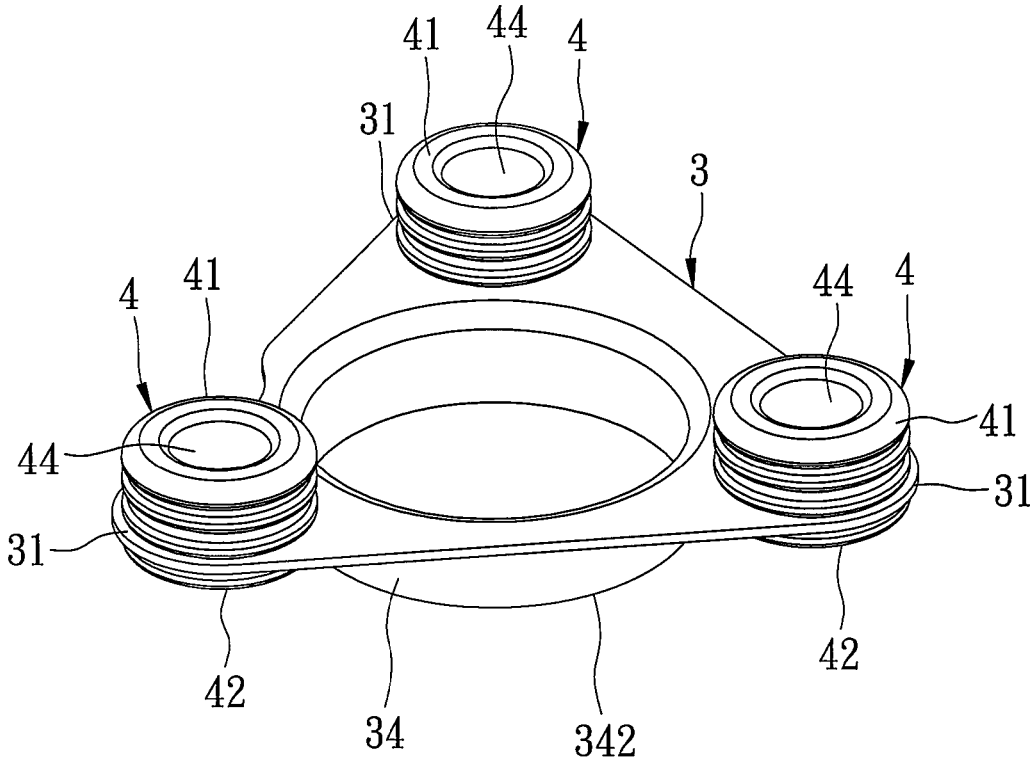
FIG. 5 is a perspective view of the preferred embodiment.
Figure 6:
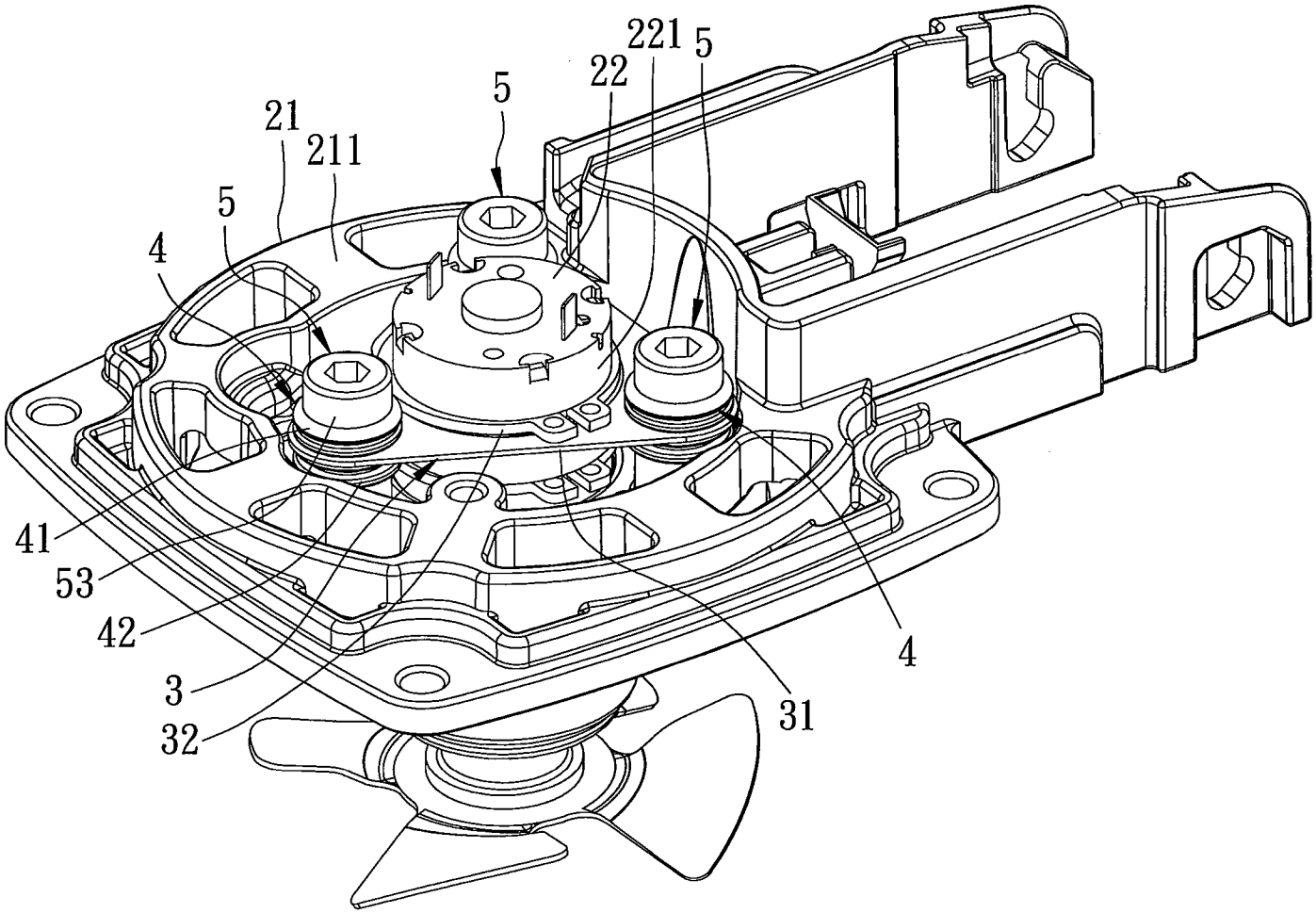
FIG. 6 is a perspective view of the preferred embodiment mounted on the cylinder head.
Figure 7:
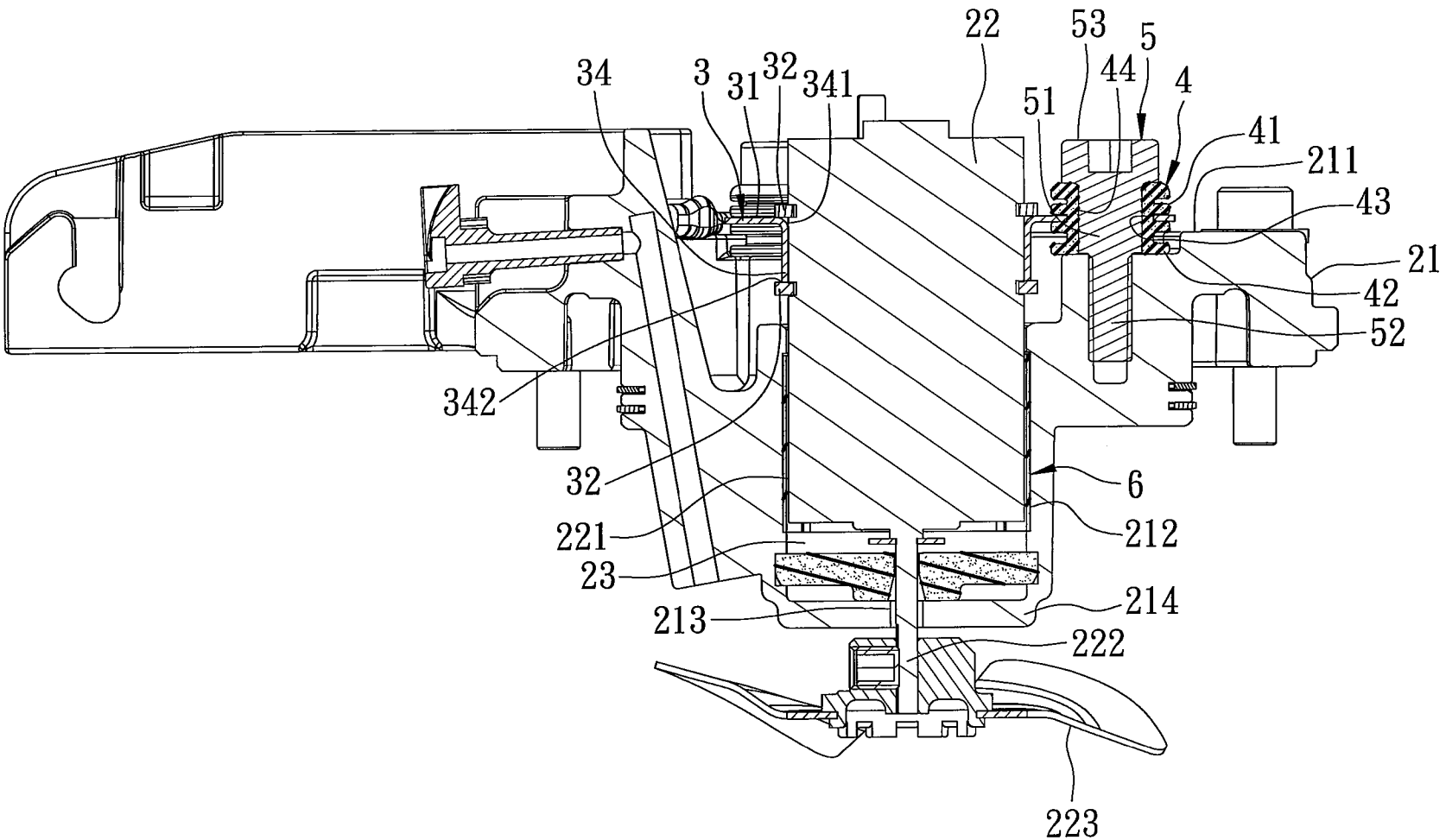
FIG. 7 is a sectional view of the preferred embodiment mounted on the cylinder head.

Referring to FIGS. 5 and 7, since the damper units 4 are respectively fitted in the mounting holes 33 in the lugs 31 of the mount 3, and since the mount 3 is made from a rigid material, in assembly, the tubular wall 34 of the mount 3 can be smoothly sleeved on the barrel wall 221 of the fan motor 22 to permit the upper and lower retaining hoops 32 to hoop around the barrel wall 221 of the fan motor 22. Subsequently, the lugs 31 are disposed to rest on the upper major surface 211 of the cylinder head 21 so that the fan motor 22 is disposed in the cavity 212 along the rotary axis (X). Thereafter, the axial-play setting units 5 are respectively inserted through the penetrating holes 44 in the damper units 4 and are threadedly engaged with the upper major surface 211 of the cylinder head 21 so as to firmly secure the mount 3 and the fan motor 22 to the cylinder head 21.

As illustrated, the enlarged head 53 is spaced apart from the lugs 31 by the upper damping members 41, and the lugs 31 are spaced apart from the cylinder head 21 by the lower damping members 42. Thus, during operation of the tool, axial oscillation of the fan motor 21 can be efficiently reduced by means of the damping units 4. In addition, by virtue of the rigid mount 3 and the axial-play setting units 5, the fan motor 22 can be firmly secured to the cylinder head 21 in a convenient manner.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

We claim:

1. An oscillation reducing suspension device for a fan motor of a combustion-powered tool, the combustion-powered tool including a cylinder head which is disposed to cover a combustion chamber, and which has an upper major surface defining a cavity that extends along a rotary axis for accommodating the fan motor and that terminates at a floor surface that has a passage to communicate the cavity with the combustion chamber so as to permit an armature shaft of the fan motor to extend into the combustion chamber, and a fan which is received in the combustion chamber, and which is rotated with the armature shaft, said oscillation reducing suspension device comprising:

at least one axial-play setting unit which is adapted to be mounted on the upper major surface, and which is configured to have upper and lower limit defining members that are spaced apart from each other by an axial play route extending parallel to the rotary axis, and that are made from a rigid material;

a suspending mount configured to keep a barrel wall of the fan motor oriented in the rotary axis, and including at least one lug which is disposed to correspond to said axial-play setting unit, and which extends radially relative to the rotary axis and into said axial play route such that said axial play route is divided into i) a proximate region between the upper major surface of the cylinder head and the at least one lug and ii) a distal region between the at least one lug and the at least one upper limit defining member of the at least one axial-play setting unit; and at least one damper unit including upper and lower damping members which are respectively disposed in said distal and proximate regions.

2. The oscillation reducing suspension device according to claim 1, wherein said mount has a tubular wall which surrounds and which extends along the rotary axis to terminate at upper and lower tubular ends such that said lug extends radially from said tubular wall, and which is adapted to be sleeved on the barrel wall of the fan motor, and upper and lower retaining hoops which are adapted to hoop around the barrel wall of the fan motor, and which are configured to flank said tubular wall along the rotary axis such that said upper and lower retaining hoops are brought to respectively abut against said upper and lower tubular ends, thereby ensuring immobility of said mount relative to the fan motor.

3. The oscillation reducing suspension device according to claim 2, wherein said lug has a mounting hole extending therethrough along said axial play route, said damper unit further including a neck member which interconnects said upper and lower damping members and which is configured to be fit in said mounting hole.

4. The oscillation reducing suspension device according to claim 3, wherein said neck member is integrally formed with said upper and lower damping members so that said damper unit is formed as a single-piece structure.

5. The oscillation reducing suspension device according to claim 4, wherein said damping unit has a penetrating hole which extends therethrough to define part of said axial play route, said axial-play setting unit being in form of a bolt which has an enlarged head that abuts against said upper damping member to serve as said upper limit defining member, and a shank extending from said enlarged head and including an insert segment that is insertable into said penetrating hole, and a threaded segment that is disposed to be in threaded engagement with the upper major surface to serve as said lower limit defining member so as to permit adjustment of length of said axial play route.

6. The oscillation reducing suspension device according to claim 1, further comprising a heat-insulating bushing adapted to be disposed in the cavity and configured to surround the barrel wall of the fan motor so as to prevent non-axial movement of the fan motor.

7. The oscillation reducing suspension device according to claim 1, comprising three of said axial-play setting units, which are angularly displaced from one another about the axis.

* * * * *